US007470106B1

(12) United States Patent
Blattmann

(10) Patent No.: US 7,470,106 B1
(45) **Date of Patent: *Dec. 30, 2008**

(54) CENTRIFUGAL SLURRY PUMP

(75) Inventor: Urs Blattmann, Birmingham, AL (US)

(73) Assignee: Townley Manufacturing, Inc., Landler, FL (US)

( * ) Notice: Subject to any disclaimer, the term of this patent is extended or adjusted under 35 U.S.C. 154(b) by 457 days.

This patent is subject to a terminal disclaimer.

(21) Appl. No.: 11/151,638

(22) Filed: Jun. 13, 2005

Related U.S. Application Data

(63) Continuation-in-part of application No. 10/192,443, filed on Jul. 10, 2002, now Pat. No. 6,921,242.

(60) Provisional application No. 60/304,295, filed on Jul. 10, 2001.

(51) Int. Cl.
*F04D 29/44* (2006.01)

(52) U.S. Cl. ..... 415/196; 415/206

(58) Field of Classification Search ..... 415/206, 415/1, 121.1, 121.2, 196, 204, 914; 416/182, 416/185, 186 R See application file for complete search history.

(56) References Cited

U.S. PATENT DOCUMENTS 5,797,724 A * 8/1998 Liu et al. ..... 415/206
5,941,536 A * 8/1999 Hill ..... 415/196
6,921,242 B2 * 7/2005 Blattmann ..... 415/206

* cited by examiner

*Primary Examiner*—Richard Edgar
(74) *Attorney, Agent, or Firm*—Allen, Dyer, Doppelt, Milbrath & Gilchrist, P.A.

(57) ABSTRACT

An apparatus and method for a slurry pump having improved erosion characteristics. The pump comprises a rotatable impeller having at least one impeller vane, an impeller shroud having an inlet for conveying slurry to the impeller and an outlet for discharging slurry accelerated by the impeller, and a pump housing having a side wall with a recess therein, said recess being deep enough to therein matingly receive said impeller shroud outlet so as to form a joint surface producing a sufficient impingement angle between the impeller shroud outlet and the pump housing side wall to substantially reduce erosion thereon by the accelerated slurry.

17 Claims, 14 Drawing Sheets

图 9

CENTRIFUGAL SLURRY PUMP

RELATED APPLICATION

This application is a continuation-in-part of and claims priority from application Ser. No. 10/192,443 which was filed on Jul. 10, 2002, now U.S. Pat. No. 6,921,242 and which claimed priority from provisional application Ser. No. 60/304,295, which was filed on Jul. 10, 2001, all priority applications being incorporated herein by reference in their entirety.

FIELD OF THE INVENTION

The present invention relates to the field of pumps and, more particularly, to a centrifugal slurry pump having improved wear characteristics.

BACKGROUND OF THE INVENTION

A slurry is formed by suspending a ground solid in a liquid. Slurries are employed for transporting ground solids in operations such as mining, marine dredging, and others. Slurry pumps are used in the hydraulic transport of these slurries and, depending on the physical hardness of the suspended solids, slurry pumps must operate in potentially very abrasive environments.

The mechanics of "wear" in a centrifugal slurry pump are multifaceted and vary depending on the overall hydraulic design of the system and of the pump itself, as well as the operating conditions in terms of the concentration and physical make-up of the solids in the slurry. A particular nuisance is the wear that occurs at the periphery of the impeller outlet and its adjacent components, these being the pump housing or casing and suction liner and, depending on the pump design, the gland side or engine side liner. The root cause of this problem is the recirculating eddy current impingement wear that occurs as the solids-laden slurry exits the impeller outlet and enters the pump housing. This problem is ever present and does not discriminate between manufacturers and pump designs.

SUMMARY OF THE INVENTION

With the foregoing in mind, the present invention advantageously provides a centrifugal slurry pump which minimizes the pump wear which occurs as a result of impingement erosion of pump components by the slurry. The present invention, therefore, provides a slurry pump with improved wear characteristics.

The present slurry pump has improved erosion characteristics and comprises a rotatable impeller, an impeller shroud, and a pump housing. The rotatable impeller having at least one impeller vane and impeller shroud, and which has an inlet for conveying slurry to the impeller and an outlet for discharging slurry accelerated by the impeller. A pump housing has a side wall with a recess therein, the recess being deep enough to therein engage the shroud outlet so as to form a joint surface producing an impingement angle sufficient to substantially reduce impingement erosion thereon by the accelerated slurry discharged by the impeller through the outlet.

BRIEF DESCRIPTION OF THE DRAWINGS

Some of the features, advantages, and benefits of the present invention having been stated, others will become apparent as the description proceeds when taken in conjunction with the accompanying drawings, presented for solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 12:
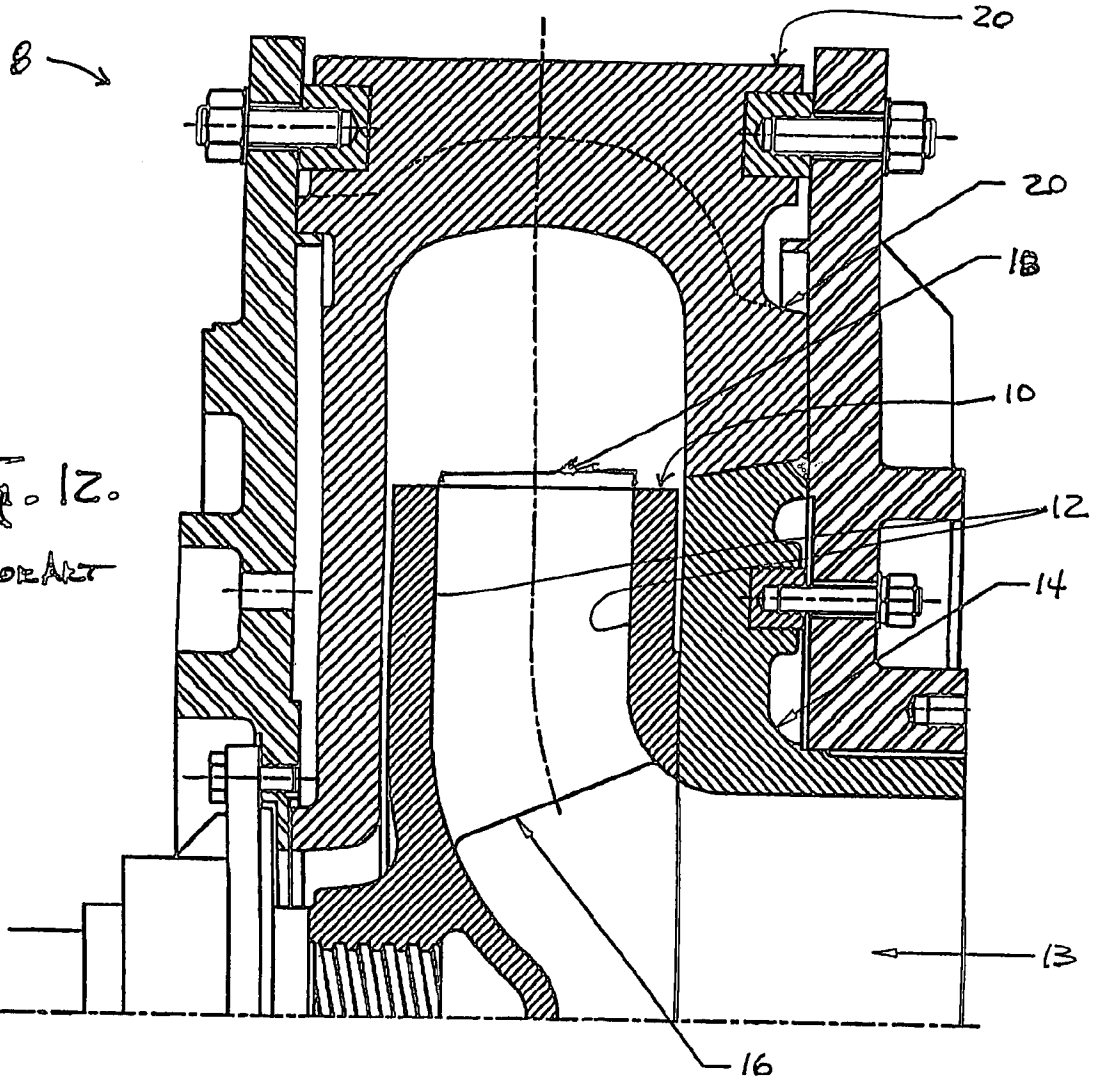
FIG. 12 PRIOR ART
FIG. 12 is a partial cross sectional view of a typical prior art centrifugal slurry pump.

Depicted in FIG. 12 is a common configuration for a typical prior art slurry pump 8, which comprises a rotating impeller 10 having an impeller shroud 12. Located adjacent the impeller is a stationary suction liner 14 which is intended to protect the susceptible portions of the impeller shroud 12 from wear due to erosion by the slurry entering the impeller by an inlet 13. As the impeller 10 rotates, it creates a low pressure zone in the inlet and slurry is forced into the impeller by atmospheric pressure. The slurry is then accelerated by centrifugal force generated by the impeller 10 and passes through the impeller vane(s) 16 to exit the impeller through the impeller shroud outlet 18 and into the pump housing 20.

Figure 13:
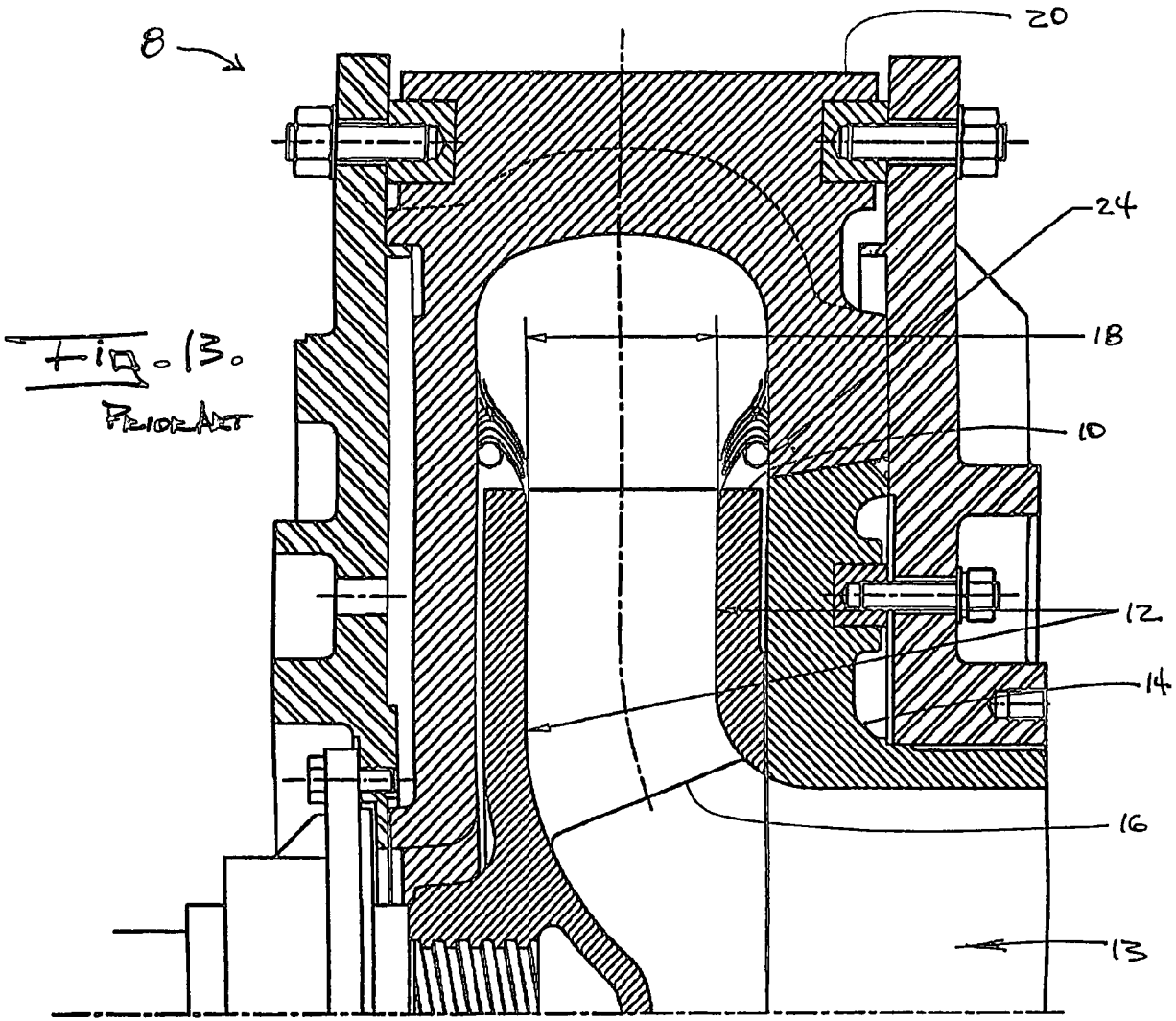
Fig. 13 PRIOR ART
FIG. 13 illustrates a recirculating eddy impingement erosion effect in the prior art centrifugal slurry pump of FIG. 12.

Generally, the impeller shroud outlet 18 matingly engages the pump housing 20, but is typically smaller than its complementary opening in the pump housing and fits therein in male fashion. Such engagement of impeller shroud outlet 18 and pump housing 20 is shown in FIG. 13, and as shown includes a certain amount of clearance for the impeller 10. As the slurry exits through the outlet 18 and starts to divert into the open pump housing 20 area, also sometimes called the volute, a void is created around the periphery of the lip of the impeller shroud outlet 18, which void is at a lower pressure than the discharged slurry itself. This effect, in turn, creates a recirculating eddy flow pattern 24 that is three dimensional in nature since the impeller 10 is rotating.

The linear distance from the lip of the impeller shroud outlet 18 to the side wall of the pump housing is generally very short and tends to cause the solid particles in the slurry to course a relatively steep impingement angle onto the side wall of the pump housing and other adjacent stationary components. The mechanics of impingement abrasion wear are such that an impingement angle of 0° is considered to produce "sliding abrasion" and impingement angles greater than 60° are considered to cause "impact erosion", also known in the art as impingement erosion, having properties akin to sand blasting.

Figure 14:
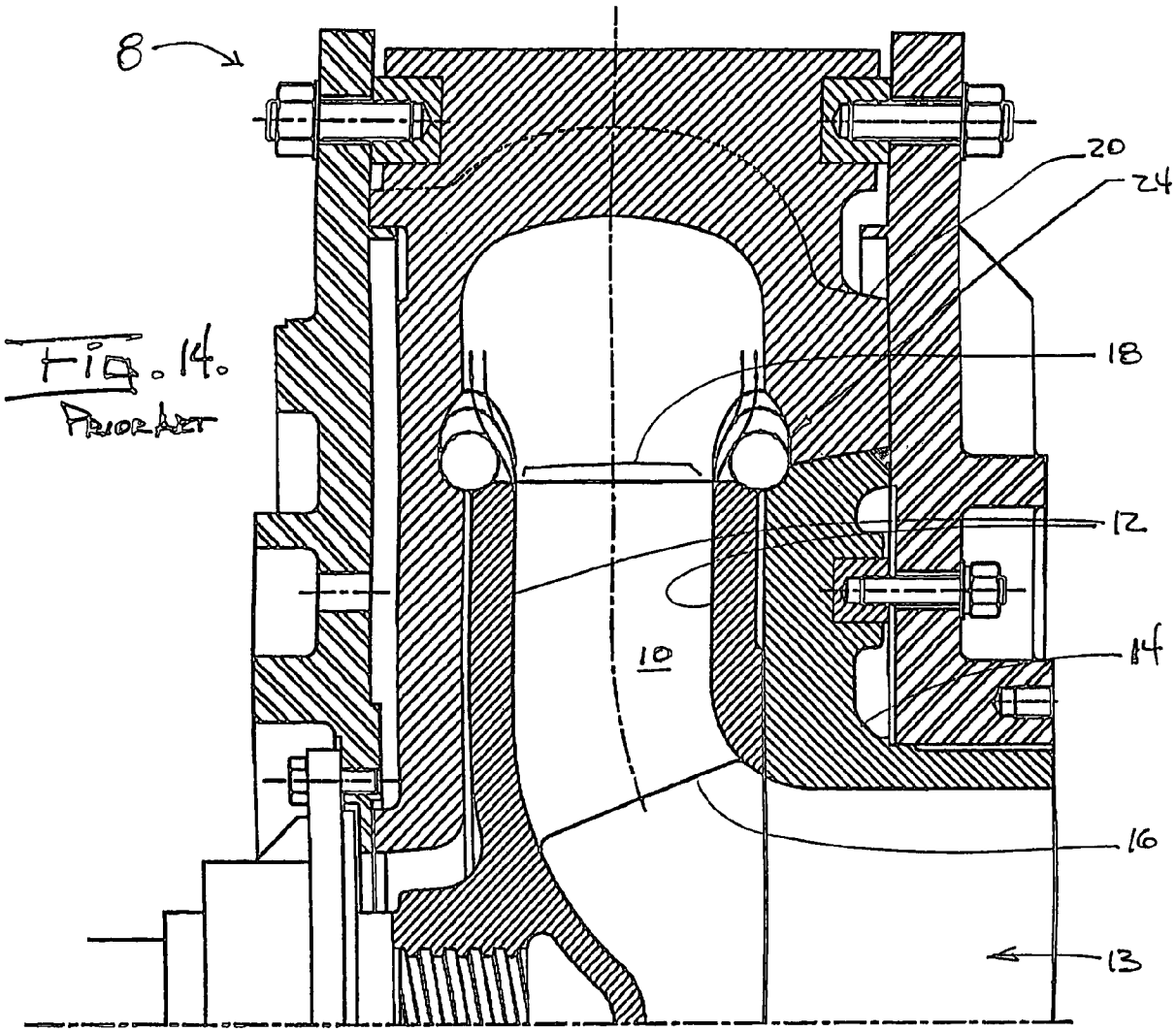
FIG. 14. PRIOR ART
FIG. 14 shows the advancement of the recirculating eddy impingement erosion in the prior art pump of FIG. 13.

Furthermore, any surface irregularities in the pump housing 20 or impeller shroud outlet 18 tend to promote the formation of wear. Additionally, the normal close proximity of the mating joint between the pump housing 20 and the suction liner 14 also contributes to accelerated wear. The described recirculating eddy flow pattern 24 has some impact erosion properties and therefore produces a rapid wear rate that will deteriorate the pump components in a very short time as depicted in FIG. 14. Once a localized wear pocket has been formed, as shown in FIG. 14, the process continues to accelerate since such discontinuities create even more turbulence and, in turn, more wear.

Figure 1:
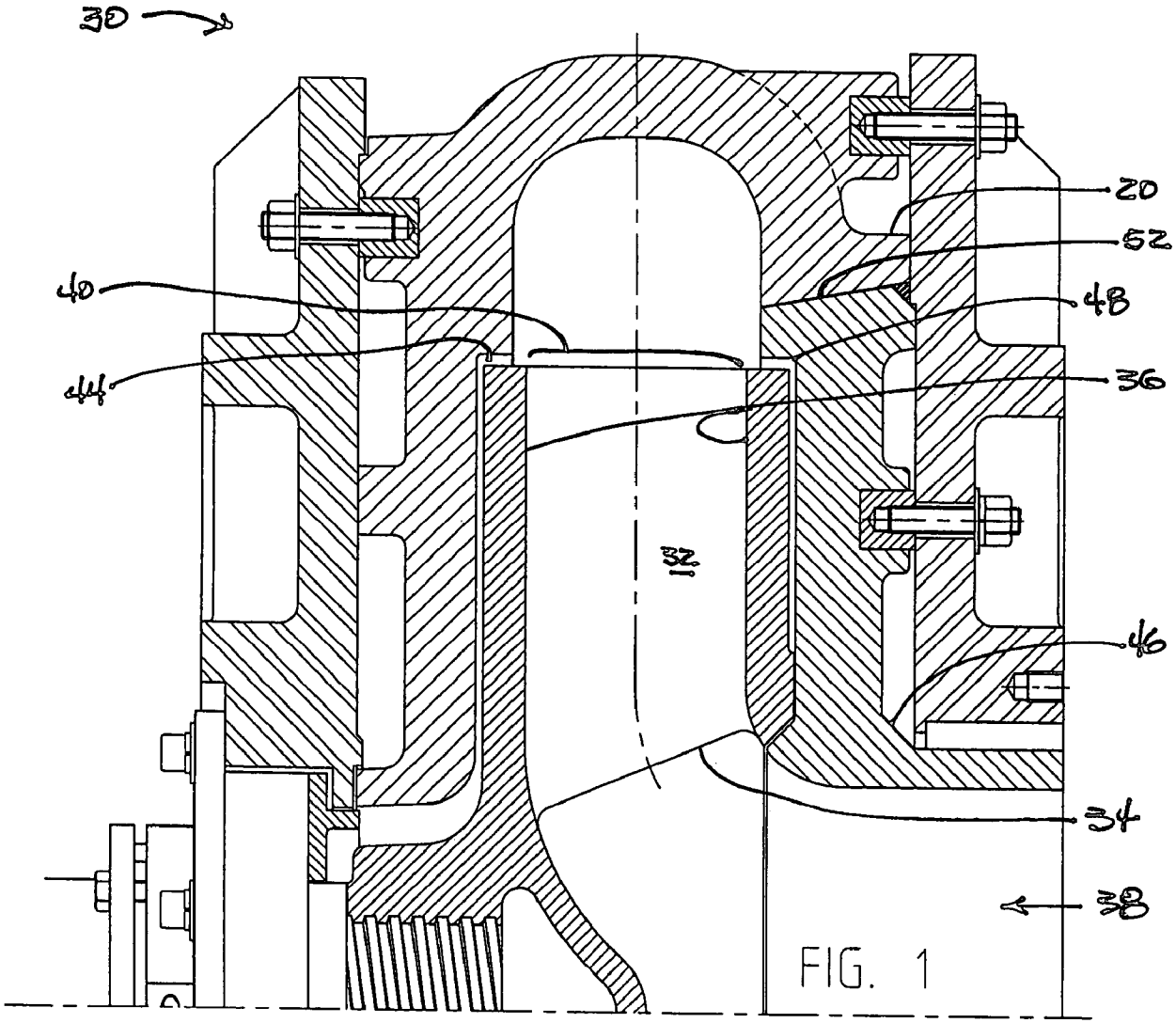
FIG. 1 shows a preferred embodiment of the present invention, with recessed impeller front and back shrouds, according to the parent application.

Shown in FIG. 1 is an embodiment of the present improved pump 30 designed to combat the adverse effects recirculating eddy wear. The pump comprises a rotatable impeller 32 having at least one impeller vane 34. The rotatable impeller 32 has an impeller shroud 36, the impeller shroud having an inlet 38 for conveying slurry to the impeller and an outlet 40 for discharging slurry accelerated by the impeller. A pump housing 42 has a side wall with a recess 44 therein, the recess being deep enough to therein engage the shroud outlet 40 so as to form a joint surface having an impingement angle sufficient to substantially reduce erosion thereon by the accelerated slurry.

As shown by way of example in the embodiment of FIG. 1, the present pump 30 may include a stationary pump housing 42 having a circular recess 44 in the gland side or engine side wall sufficiently deep to therein accommodate the width of the impeller hub side shroud. The suction liner 46 is preferably made with an enlarged diameter to move the surface irregularity caused by the joint between the suction liner and pump housing 42 away from the area where recirculating eddy wear takes place. A circular recess 48 is built into the suction liner with a depth sufficient to accommodate the impeller shroud outlet 40 width. This configuration produces a relatively undisturbed flow pattern 50 as the slurry is discharged through the impeller shroud outlet.

Figure 5:
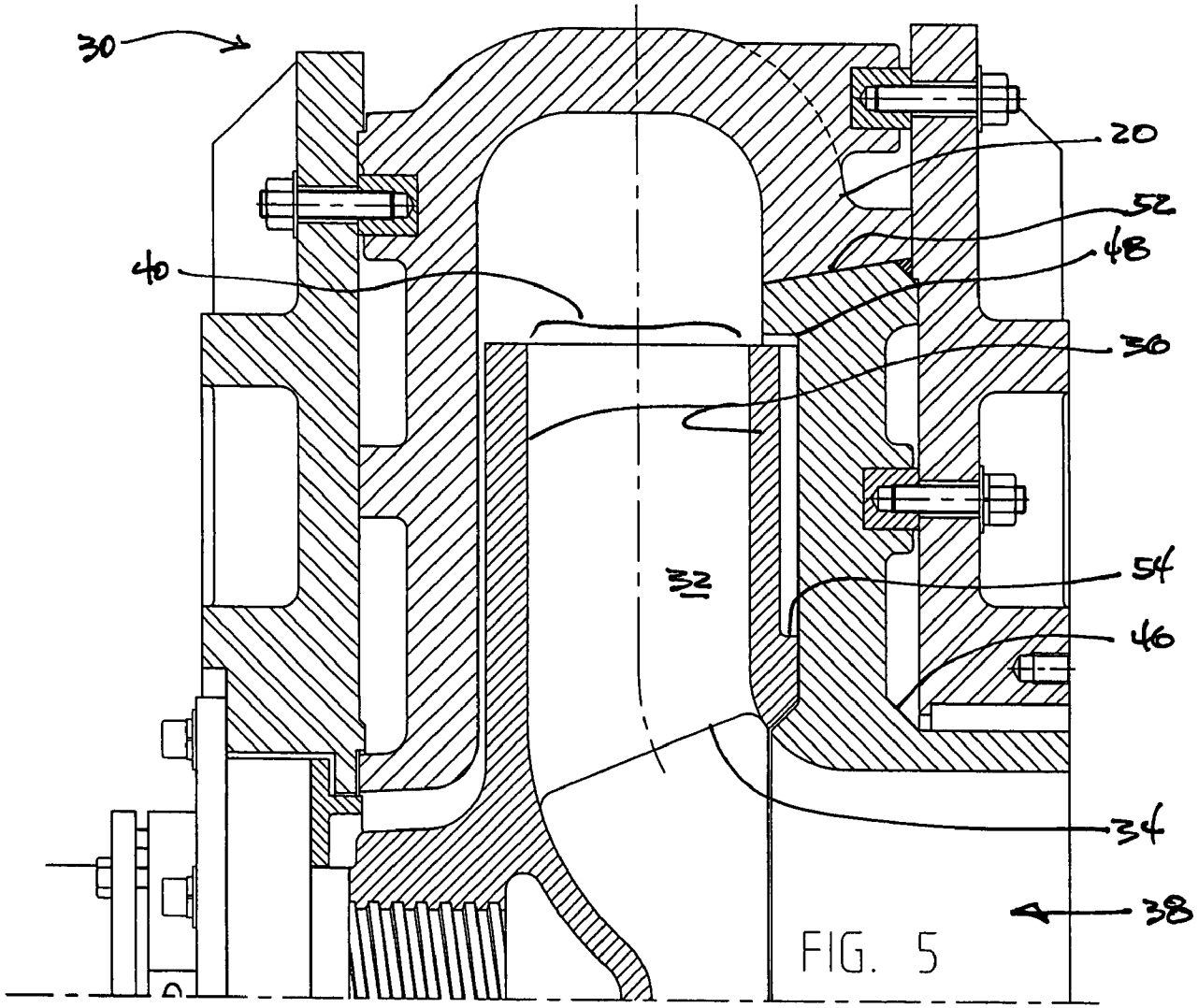
FIG. 5 depicts an alternate embodiment with an impeller suction side shroud recessed into the suction liner only and having impeller suction shroud impeller vanes, similar to the embodiment of FIG. 2.
Figure 6:
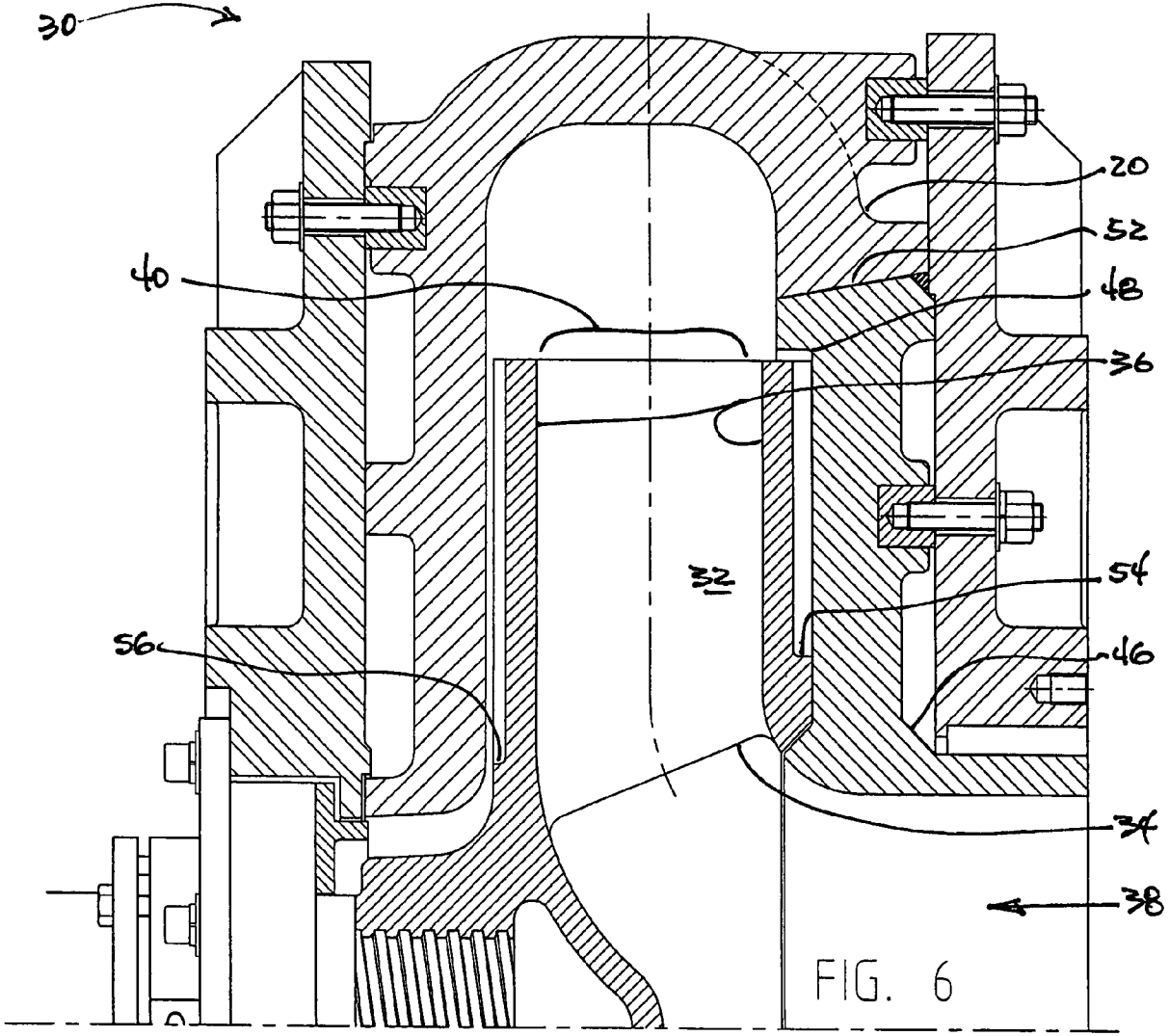
FIG. 6 shows an alternate embodiment having an impeller suction side shroud recessed into the suction liner and having impeller suction and hub shroud impeller vanes, similar to the embodiment of FIG. 3.
Figure 7:
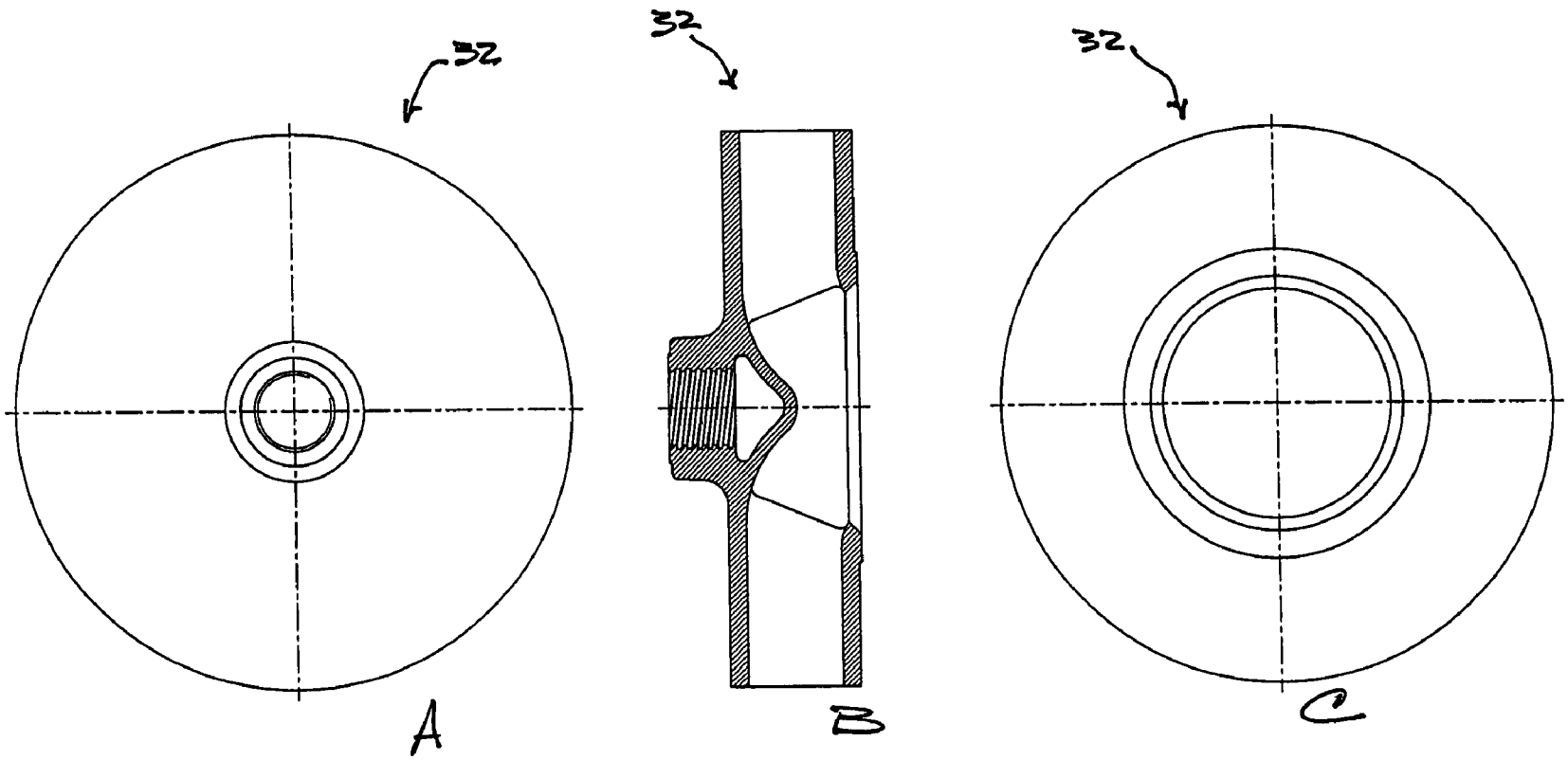
FIG. 7 depicts an impeller according to the parent application, and as shown also in FIGS. 1 and 4.

As noted above, FIG. 1 shows a preferred embodiment of the present invention according to the parent application. The slurry pump of the present invention, however, is shown in FIGS. 2-11. FIGS. 12-14 illustrate prior art slurry pumps for comparison with the present pump. FIG. 4 is yet another embodiment of the present slurry pump, a variation of that pump shown in FIG. 1 but having an impeller suction side shroud recessed into the suction liner only. A top plan view of the rear surface of the impeller, a cross sectional view of same, and top plan view of the front of the impeller in these two embodiments are shown in FIG. 7.

Figure 2:
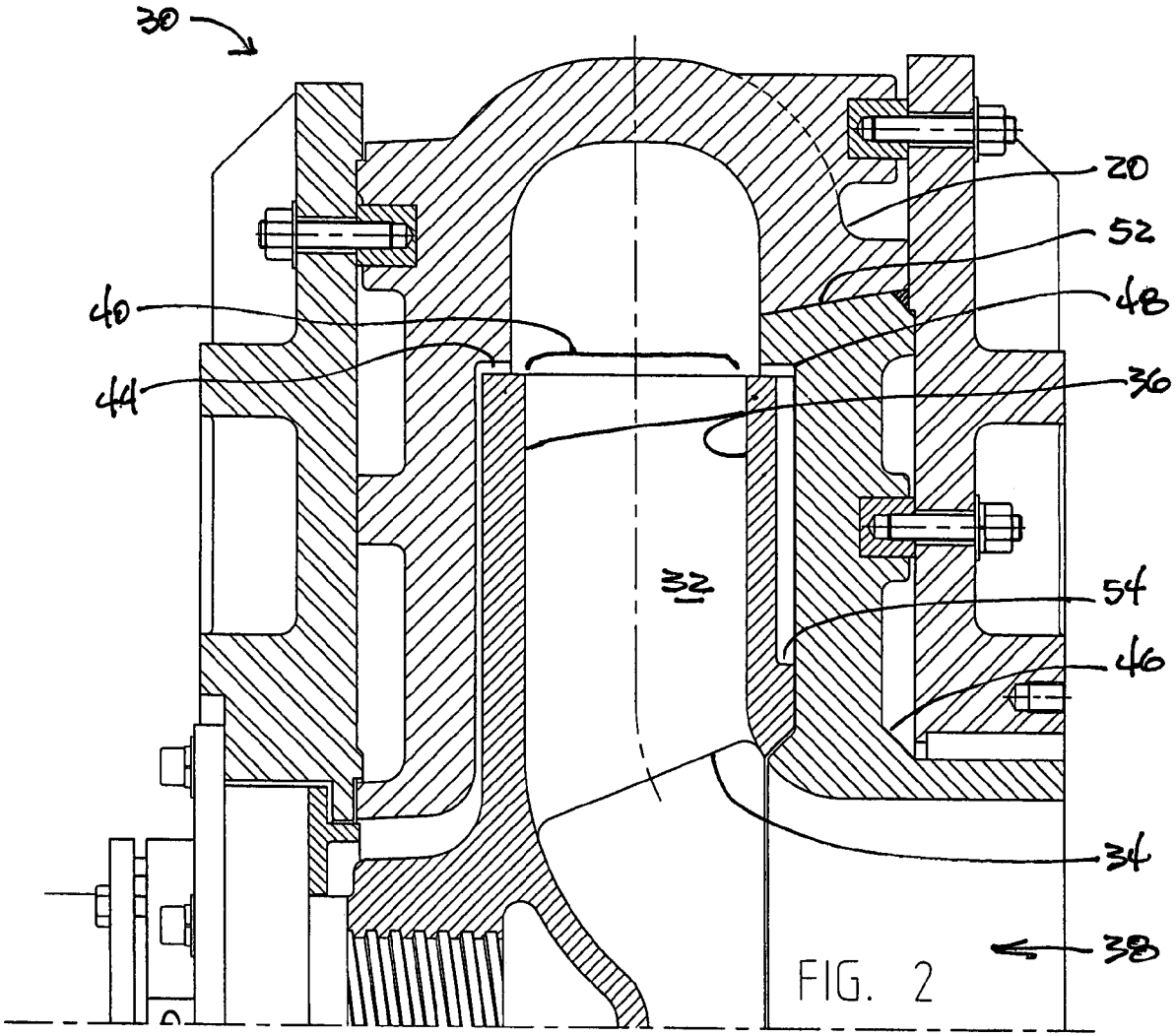
FIG. 2 depicts a variation on the pump of FIG. 1, with recessed front and back shrouds combined with impeller suction shroud impeller vanes.
Figure 8:
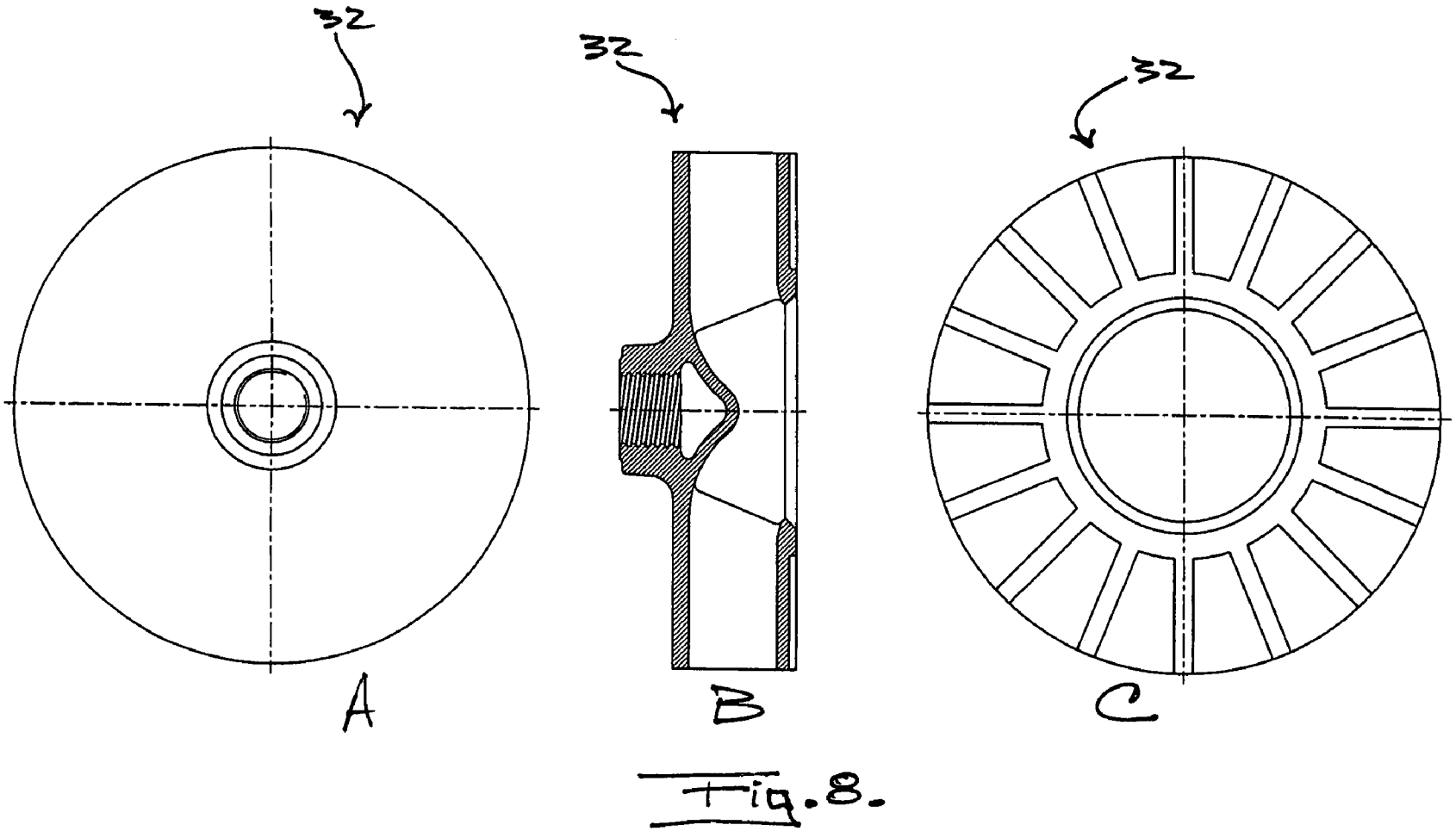
FIG. 8 illustrates an impeller according to the parent application, having straight type suction shroud impeller vanes and as also shown in FIGS. 2 and 5.
Figure 10:
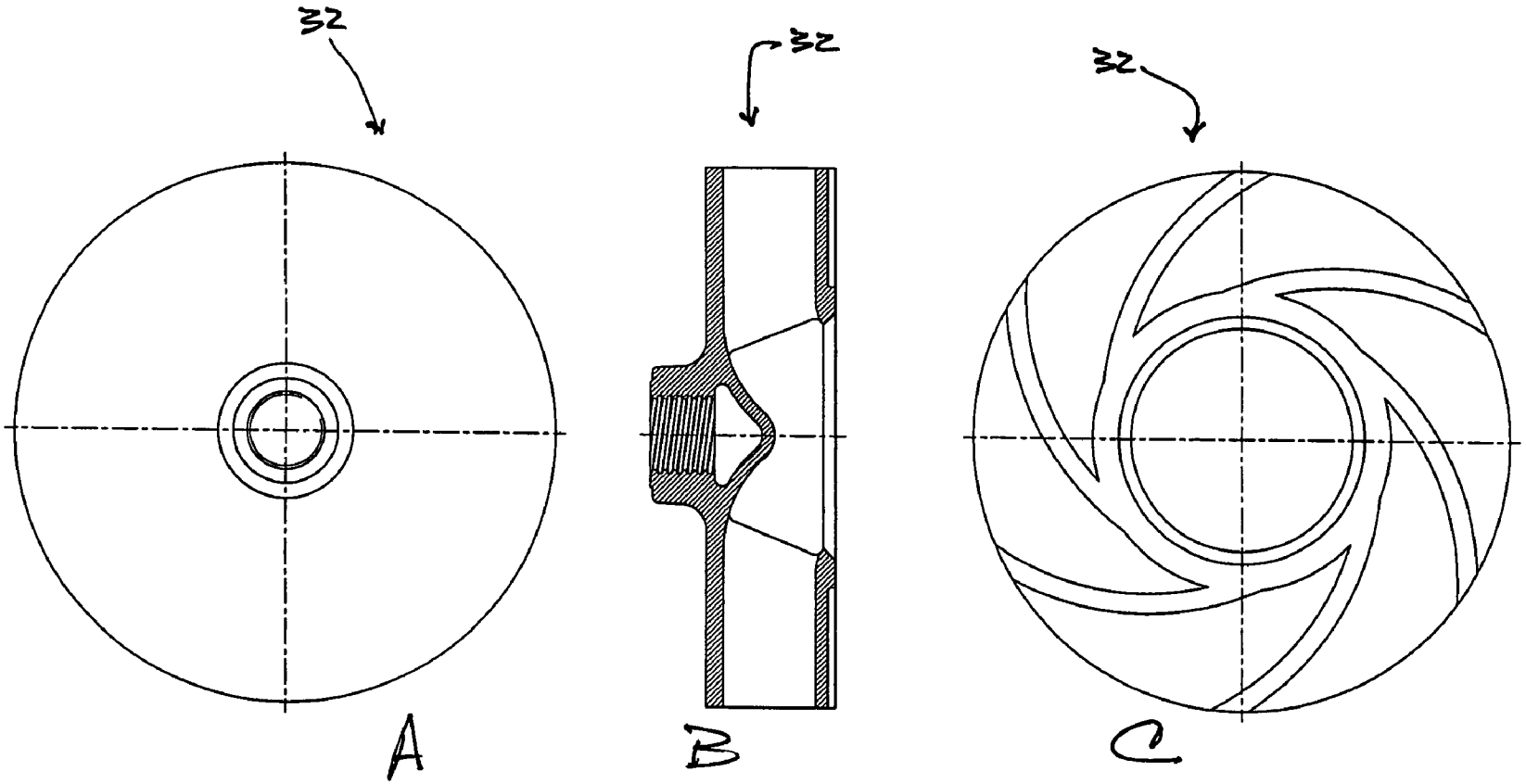
FIG. 10 is a depiction of an impeller according to the parent application but having curved type suction shroud impeller vanes, refer also to FIGS. 2 and 5.

FIG. 2 depicts a variation on the pump of FIG. 1, having recessed front and back shrouds combined with impeller suction shroud impeller vanes; the front shroud having a recess itself 54 and being associated with a recess in the suction liner 48, the back shroud being associated with a recess in the pump housing 44. FIG. 5 shows an alternate embodiment with an impeller suction side shroud recessed into the suction liner only and having impeller suction shroud impeller vanes, similar to the embodiment of FIG. 2. A top plan view of the rear surface of the impeller, a cross sectional view of same, and top plan view of the front of the impeller in these two embodiments are shown in FIGS. 8 and 10, respectively.

Figure 3:
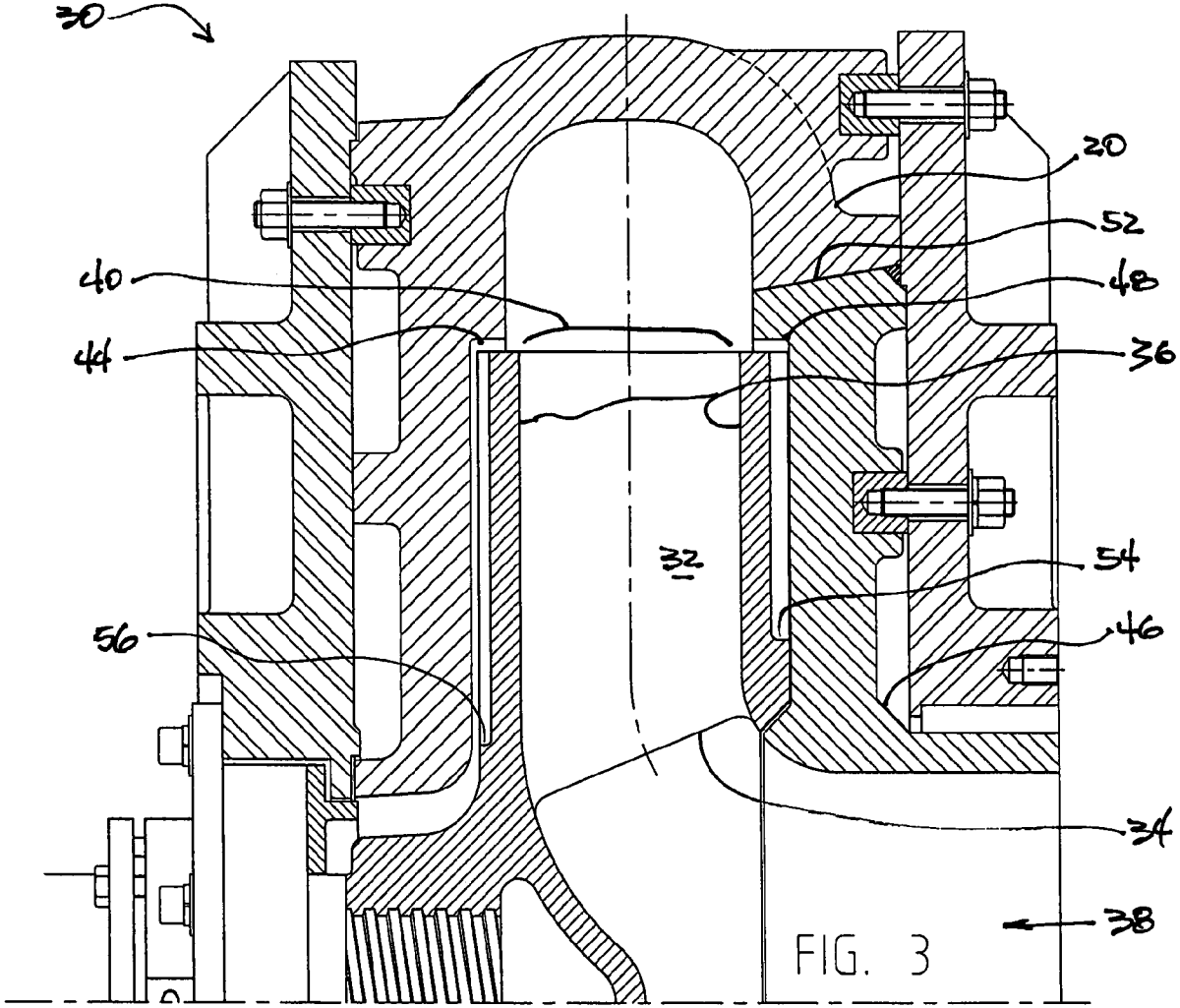
FIG. 3 illustrates yet another variation of the pump of FIG. 1, having recessed front and back shrouds combined with impeller suction and hub shroud impeller vanes.
Figure 4:
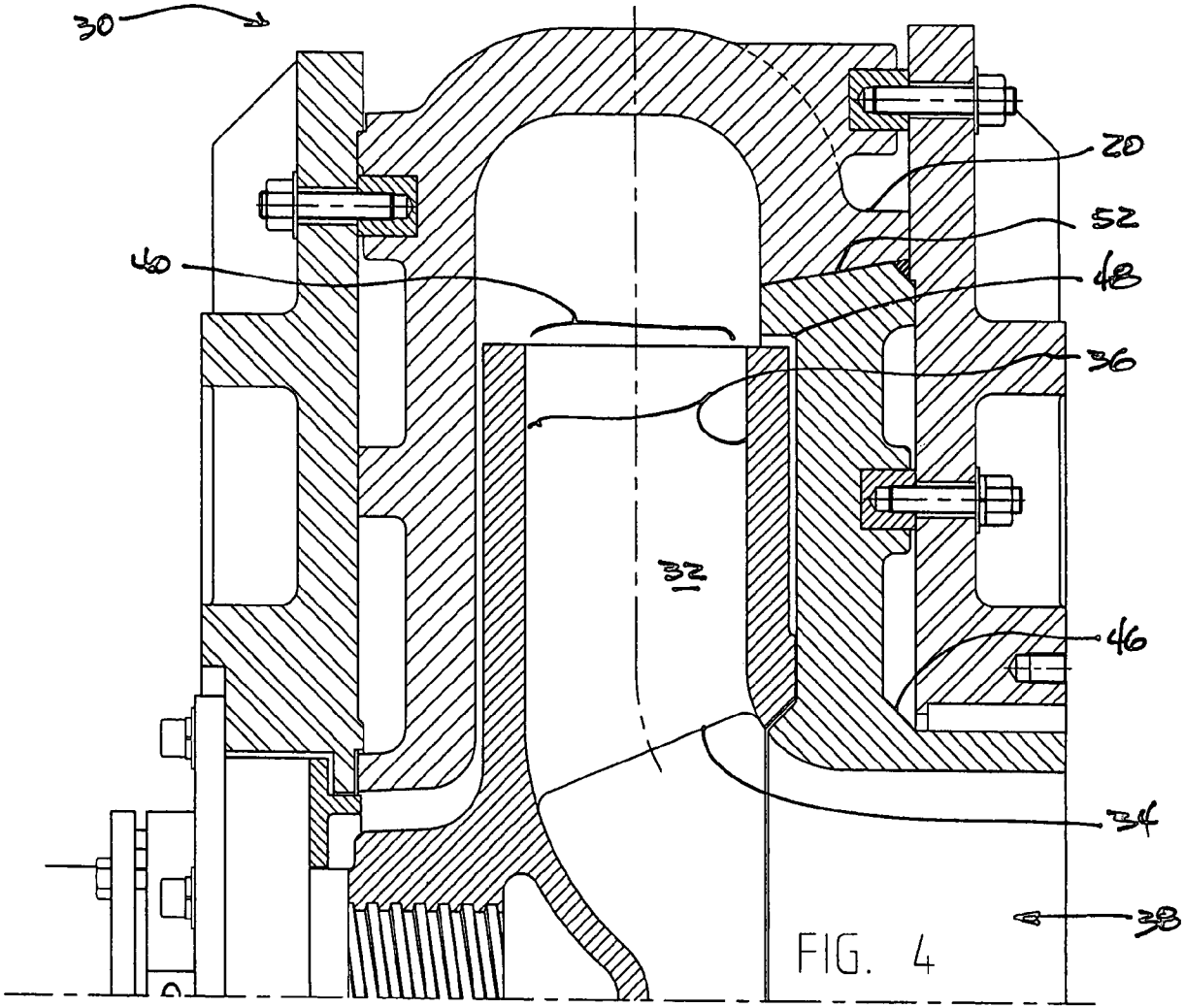
FIG. 4 is yet another embodiment of the present slurry pump, with an impeller suction side shroud recessed into suction liner only.
Figure 9:
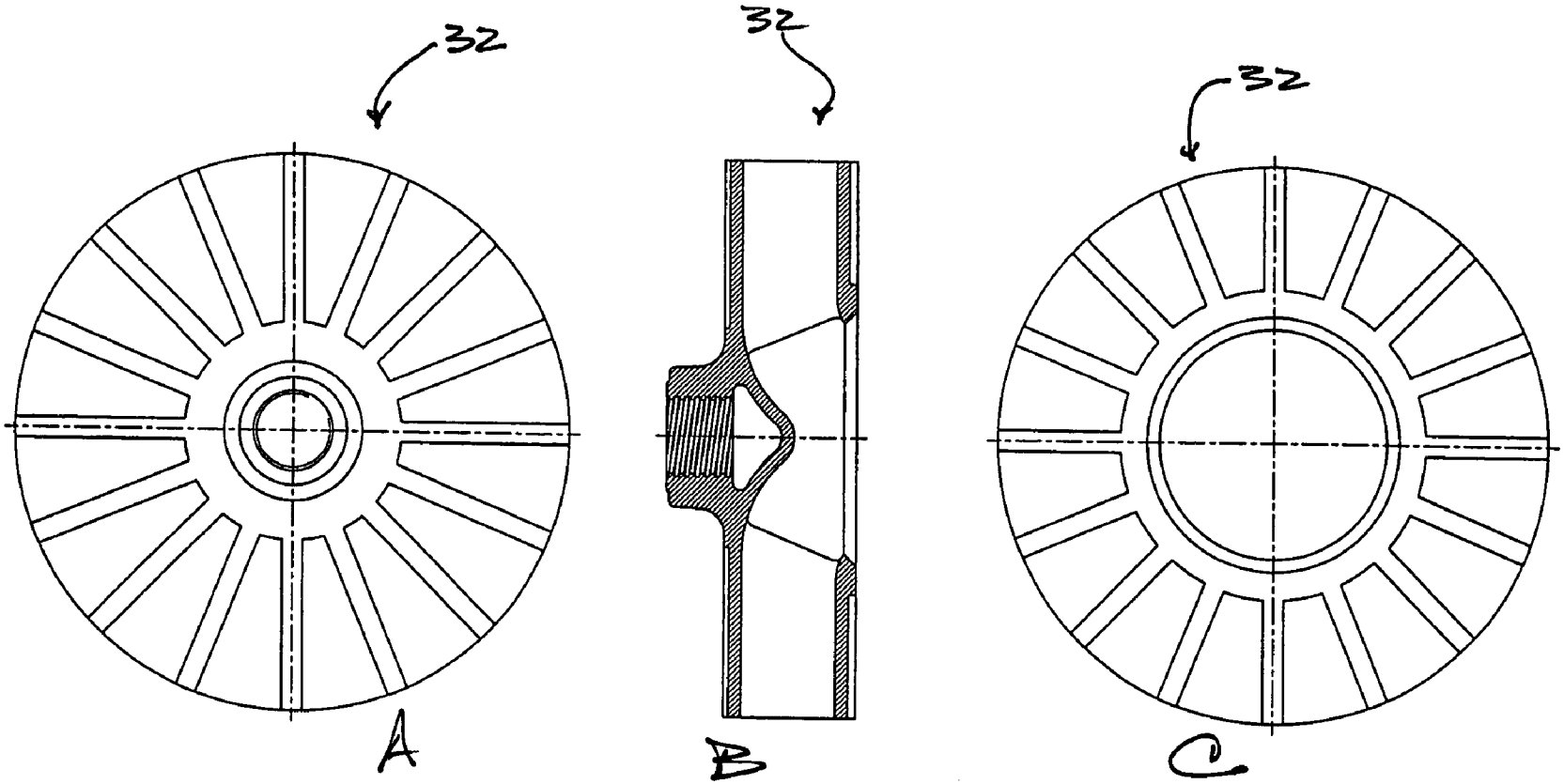
FIG. 9 shows an original design impeller according to the parent application, with straight type suction and hub shroud impeller vanes, refer also to FIGS. 3 and 6.
Figure 11:
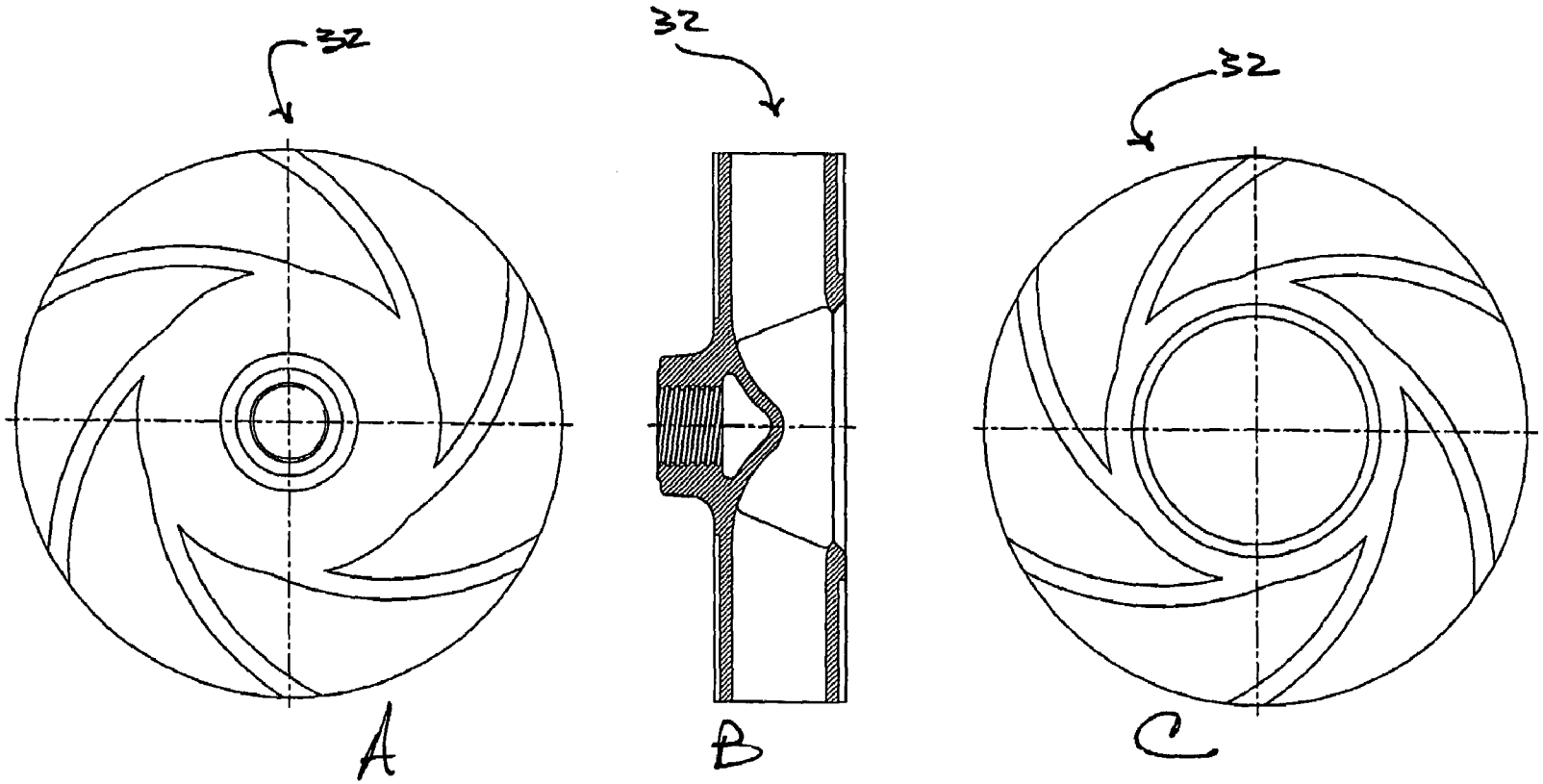
FIG. 11 is an impeller according to the parent application but having curved type suction and hub shroud impeller vanes, refer also to FIGS. 3 and 6.

FIG. 3 illustrates yet another variation of the pump of FIG. 1, having recessed front and back shrouds combined with impeller suction and hub shroud impeller vanes; the front shroud having a recess itself 54 and being associated with a recess in the suction liner 48, the back shroud also having a recess 56 and being associated with a recess in the pump housing 44. FIG. 6 shows an alternate embodiment having an impeller suction side shroud recessed into the suction liner and having impeller suction and hub shroud impeller vanes, similar to the embodiment of FIG. 3. A top plan view of the rear surface of the impeller, a cross sectional view of same, and top plan view of the front of the impeller in these two embodiments are shown in FIGS. 9 and 11, respectively.

As shown in the figures, the present slurry pump has a rotatable impeller which includes a plurality of impeller vanes and an impeller shroud, having an inlet and an outlet, and wherein the impeller shroud has a plurality of recesses formed along at least one outer surface of said impeller shroud's sidewall. The outer surface referred to may be adjacent the suction liner (FIGS. 4, 5, 7, 8 and 10), may be adjacent an engine side wall of said pump or may be both (FIGS. 3, 6, 9 and 11). Moreover, the plurality of recesses may be formed radially aligned on said impeller, so that the impeller vanes are straight (FIGS. 8C, 9A and 9C). Alternatively, the plurality of recesses may be formed spirally aligned relative to a center of said impeller so that the impeller vanes are curved and spirally aligned relative to a center of said impeller (FIGS. 10C, 11A and 11C).

For comparison to the structural features of the present slurry pump, FIGS. 12-14 show prior art pumps. FIG. 12 is a partial cross sectional view of a typical prior art centrifugal slurry pump. FIG. 13 illustrates a recirculating eddy impingement erosion effect in the prior art centrifugal slurry pump of FIG. 12. FIG. 14 shows the advancement of the recirculating eddy impingement erosion in the prior art pump of FIG. 13. In particular, one other feature of prior art pumps which should be noted is the location of the suction liner to pump housing joint 52 which is near the impeller outlet, thus resulting in yet increased wear in the pump due to the recirculating eddies discussed above and shown in FIGS. 13 and 14.

The present slurry pump eliminates or greatly reduces the void found in the prior art pump designs which cause impact erosion and recirculating eddy erosion wear in the pump components. In the present slurry pump, the less pronounced impingement angles between the impeller shroud outlet and the pump housing promote more of a sliding abrasion effect which results in increased operational life for the pump components and tends to avoid premature pump failure.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A slurry pump comprising:

a rotatable impeller having a plurality of impeller, vanes and an impeller shroud, having an inlet and an outlet and wherein said impeller shroud has a plurality of recesses formed along at least one outer surface of said impeller shroud's sidewall;

a pump housing having a side wall with a pump housing recess therein, said recess being deep enough to therein receive said impeller shroud so that an impeller shroud outlet wall and the pump housing side wall are approximately parallel to each other so as to produce a sufficient impingement angle between the impeller shroud outlet and the pump housing side wall to substantially reduce erosion thereon by the accelerated slurry; and a suction liner positioned at the inlet abutting said pump housing and having a side wall including a suction liner recess forming a continuous recess with the pump housing recess.

2. The slurry pump of claim 1 wherein the impingement angle is smaller than 60°.

3. The slurry pump of claim 1 wherein the impingement angle is larger than 0° and smaller than 60°.

4. The slurry pump of claim 1 wherein the impingement angle is larger than 0°.

5. The slurry pump of claim 1 wherein the impingement angle is sufficient to avoid producing impact abrasion by the accelerated slurry.

6. The slurry pump of claim 1, wherein said at least one outer surface is adjacent said suction liner.

7. The slurry pump of claim 1, wherein said at least one outer surface is adjacent an engine side wall of said pump.

8. The slurry pump of claim 1, wherein said at least one outer surface comprises an outer surface adjacent said suction liner and an outer surface adjacent an engine side wall of said pump.

9. The slurry pump of claim 1, wherein said plurality of recesses formed are radially aligned on said impeller.

10. The slurry pump of claim 1, wherein said plurality of impeller vanes are straight and radially aligned on said impeller.

11. The slurry pump of claim 1, wherein said plurality of recesses formed are spirally aligned relative to a center of said impeller.

12. The slurry pump of claim 1, wherein said plurality of impeller vanes are curved and spirally aligned relative to a center of said impeller.

13. A slurry pump having improved erosion characteristics, said pump comprising:

a rotatable impeller having at least one impeller vane, and an impeller shroud, having an inlet for conveying slurry to the impeller and an outlet for discharging slurry accelerated by the impeller;

a pump housing having a side wall with a pump housing recess therein, said recess being deep enough to therein receive said impeller shroud so that an impeller shroud outlet wall and the pump housing side wall are approximately parallel to each other so as to produce a sufficient impingement angle between the impeller shroud outlet and the pump housing side wall to substantially reduce erosion thereon by the accelerated slurry; and a suction liner positioned at the inlet abutting said pump housing and having a side wall including a suction liner recess forming a continuous recess with the pump housing recess, said suction liner having an enlarged diameter so that a joint formed where said suction liner and said pump housing meet is positioned a sufficient distance apart from the impeller outlet to avoid a recirculating eddy generated as slurry is expelled therethrough.

14. The slurry pump of claim 13 wherein the impingement angle is smaller than 60°.

15. The slurry pump of claim 13 wherein the impingement angle is larger than 0° and smaller than 60°.

16. The slurry pump of claim 13 wherein the impingement angle is larger than 0°.

17. The slurry pump of claim 13 wherein the impingement angle is sufficient to avoid producing impact abrasion by the accelerated slurry.

* * * * *